US005756952A

United States Patent [19]

Thuries

[11] Patent Number: 5,756,952

[45] Date of Patent: May 26, 1998

[54] STRAIGHT SPRING OPERATING MECHANISM FOR HIGH-VOLTAGE CIRCUIT-BREAKERS

[75] Inventor: Edmond Thuries, Meyzieu, France

[73] Assignee: GEC Alsthom T & D S A, Paris, France

[21] Appl. No.: 833,740

[22] Filed: Apr. 9, 1997

[30] Foreign Application Priority Data

Apr. 10, 1996 [FR] France ..... 96 04451

[51] Int. Cl.[6] ..... H01H 33/42

[52] U.S. Cl. ..... 218/154

[58] Field of Search ..... 218/1, 2, 7, 8, 218/14, 43, 45, 55–57, 67, 68, 78, 79, 80, 84, 92, 152, 153, 154

[56] References Cited

U.S. PATENT DOCUMENTS

| | | | |
|---|---|---|---|
| 2,965,736 | 12/1960 | Browne, Jr. et al. | 200/148 |
| 4,162,385 | 7/1979 | Bould et al. | 200/153 SC |
| 4,414,449 | 11/1983 | Garzon | 200/146 R |
| 4,535,208 | 8/1985 | Wallimann et al. | 200/82 B |
| 4,678,877 | 7/1987 | Nicoloso | 200/148 F |
| 5,508,487 | 4/1996 | Smith et al. | 218/154 |

FOREIGN PATENT DOCUMENTS

| | | | |
|---|---|---|---|
| 0221430A1 | 5/1987 | European Pat. Off. | H01H 3/30 |
| 0660347A1 | 6/1995 | European Pat. Off. | H01H 3/30 |

*Primary Examiner*—Michael L. Gellner
*Assistant Examiner*—Michael A Friedhofer
*Attorney, Agent, or Firm*—Sughrue, Mion, Zinn, Macpeak & Seas, PLLC

[57] ABSTRACT

An operating mechanism for a circuit-breaker, for carrying out an O-C-O cycle, followed by a C-O cycle, includes a tripping spring and a setting spring, coaxial with each other. Expansion of the setting spring compresses the tripping spring. The setting spring is compressed by an arrangement coaxial with the springs including a reversible electric motor.

9 Claims, 7 Drawing Sheets

STRAIGHT SPRING OPERATING MECHANISM FOR HIGH-VOLTAGE CIRCUIT-BREAKERS

BACKGROUND OF THE INVENTION

1. Field of the Invention

The present invention concerns an operating mechanism for operating a high-voltage circuit-breaker.

To be more precise, the invention concerns an operating mechanism including straight springs for effecting the opening and closing cycles habitually required by users.

2. Description of the Prior Art

The cycle most commonly required is a cycle comprising opening, reclosing after 0.3 second followed by opening within a time-delay of 0.02 s if the fault has not cleared. A cycle of this kind is generally 0designated by the following abbreviation: O-0.3 sC–0.02sO.

A circuit-breaker that has effected a O-0.3sC–0.02sO cycle is also required to be able to close again after a maximal time-delay of 15 s, this closing possibly being followed by opening within a time-delay of 0.02 s if the fault persists.

U.S. Pat. No. 4,678,877 describes a straight spring operating mechanism for high-voltage circuit-breakers capable of effecting the above cycles.

This operating mechanism has a number of disadvantages.

The device for recharging the springs is complex; it comprises many parts and in particular a ratchet wheel which is subject to rapid wear and requires frequent replacement.

One aim of the invention is to provide a more rugged operating mechanism with reduced maintenance requirements.

The recharging device of the operating mechanism described in the patent referred to above is bulky.

Another aim of the invention is to provide an operating mechanism that is more compact and has greater axial symmetry, which enables it to be accommodated under the poles of the circuit-breaker.

SUMMARY OF THE INVENTION

The invention consists in an operating mechanism for a circuit-breaker for effecting a rapid opening, closing and reopening cycle of the circuit-breaker (O-C-O cycle), the operating mechanism including a rod coupled to a circuit-breaker operating link, the rod being movable by a first or tripping spring, the operating mechanism further including a second or setting spring on the axis xx of the first spring and the expansion of which compresses the tripping spring, the operating mechanism also including means for compressing the tripping spring after a tripping operation, the compression means including a motor coaxial with the springs and driving in translation along its axis a rod disposed on the axis of the springs, the rod being attached to arms cooperating with a ring on which the setting spring bears.

The bearing ring on which the setting ring bears is advantageously attached to a mobile cylinder one end of which cooperates with a disk on which the tripping spring bears during compression of the tripping spring.

In accordance with the invention, the end of the mobile cylinder includes a ring of pivoting fingers provided with shoulders on which the bearing disk of the tripping spring bears during the compression of the latter, the fingers coming into contact at the end of the travel of the cylinder with a fixed cylinder and spreading apart, releasing the disk.

The travel of the mobile cylinder advantageously overshoots the normal abutment position of the bearing disk of the tripping spring in order to enable the repositioning of the abutments of the disk.

The end of the arms is fixed to a common ring which bears on the bearing ring of the setting spring during recompression of the setting spring.

The travel of the arms overshoots the normal abutment position of the bearing ring of the setting spring to enable repositioning of the abutments of the ring.

The pivoting arms include an overcenter toggle device to enable the ring of fingers to assume two fixed positions.

The foot of each finger has an external portion cooperating with a fixed cylinder to enable the ring of pivoting fingers to move from the spread apart position to the inverse position at the end of the maneuver to recompress the setting spring.

One embodiment of the invention will now be described with reference to the accompanying drawings.

DETAILED DESCRIPTION OF THE PREFERRED EMBODIMENT

The embodiment described concerns a circuit-breaker with one interrupter chamber for each pole; of course, the operating mechanism of the invention applies to a circuit-breaker comprising a plurality of interrupter chambers for each pole, for example two chambers in a T-configuration.

Figure 1:
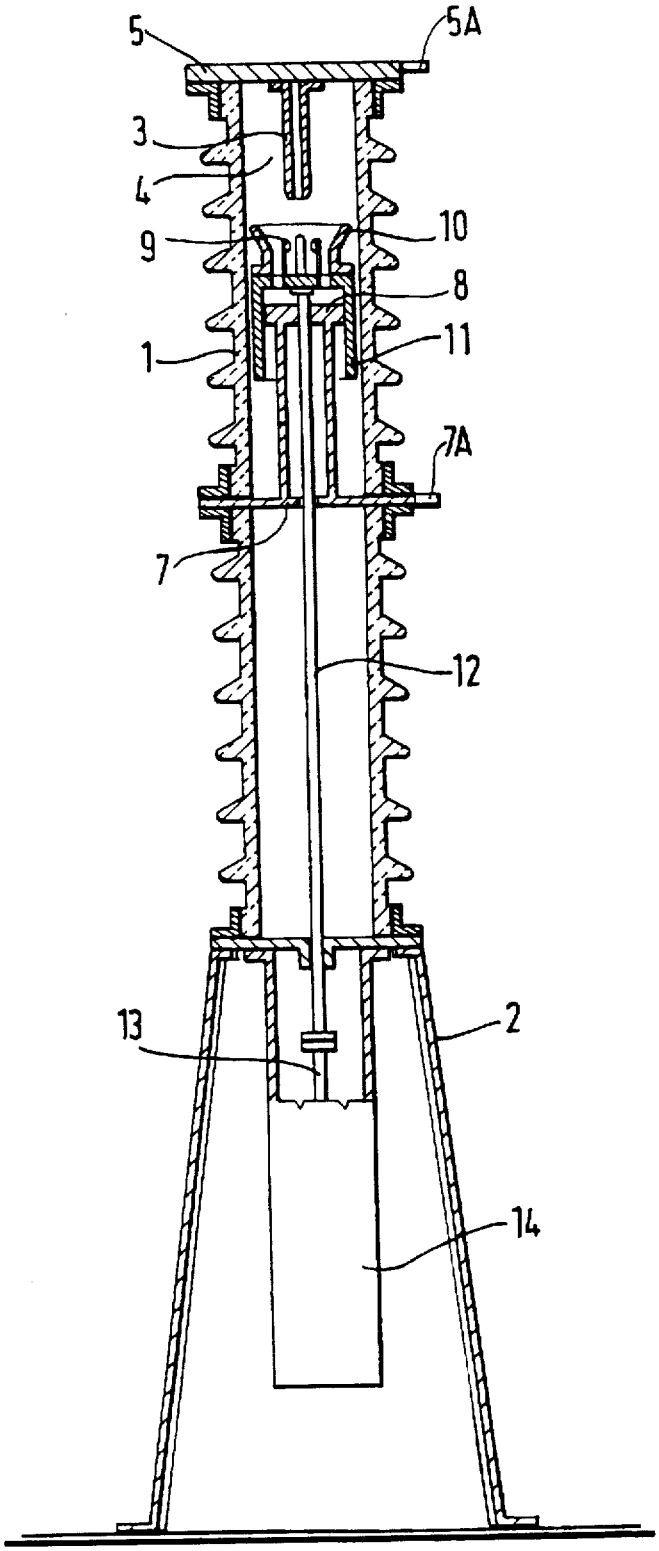
FIG. 1 is a schematic and partially sectional elevation view of a circuit-breaker pole provided with the operating mechanism of the invention.

In FIG. 1, the reference number 1 designates an insulative column of a circuit-breaker pole. The column rests on a chassis 2 fixed to the ground.

A fixed contact 3 is disposed in the interrupter chamber 4 filled with insulative gas such as sulfur hexafluoride $SF_6$.

The chamber 4 is delimited at the top by a first flange 5 to which is fixed a first terminal 5A and at the bottom by a second flange 7 to which is fixed a second terminal 7A.

The reference number 8 designates a fixed puffer piston. The mobile assembly comprises contacts 9 and a nozzle 10 attached to a cylinder 11 cooperating with the piston 8. The cylinder is coupled to an operating rod 12 which passes through and is sealed to the flange 7.

The rod 12 is coupled to a rod 13 which is part of the operating mechanism shown by the rectangle 14 in FIG. 1.

The operating mechanism is fixed to the chassis 2 by means that are not shown; it is placed directly under the pole to be operated.

Figure 2:
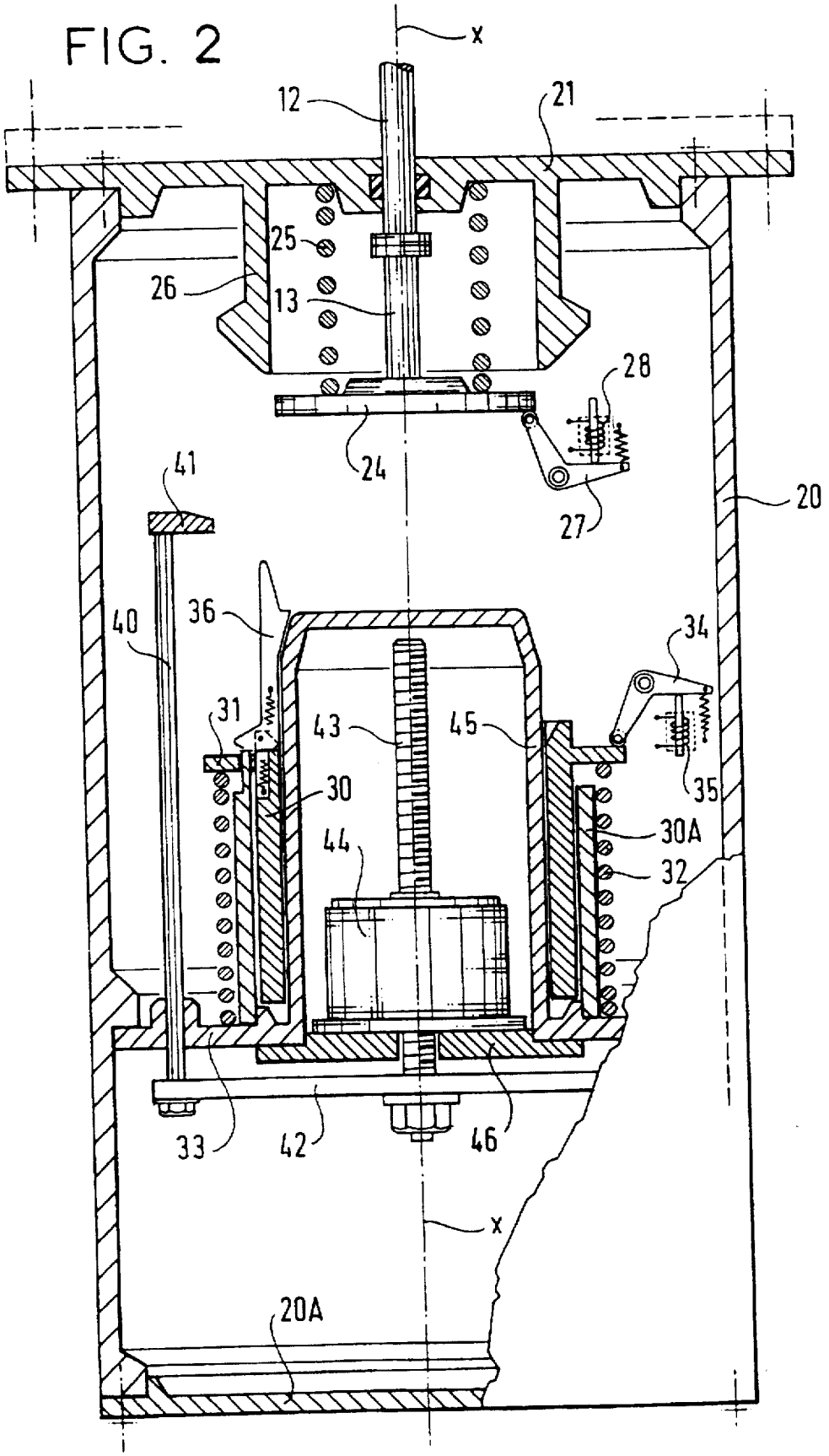
FIG. 2 is a schematic view of the operating mechanism of the invention in axial section, in the configuration corresponding to the closed state of the circuit-breaker.

Refer now to FIG. 2 which shows an operating mechanism of the invention in axial section, in the configuration corresponding to the circuit-breaker set in normal operation.

The operating mechanism includes a metal frame 20, preferably cylindrical and concentric with the axis xx, which is fixed rigidly under the interrupt chamber of the circuit-breaker by means that are not shown. The cylinder 20 is closed by a bottom 20A. The top of the frame includes a cover 21 including an orifice through which the link 12 for operating the circuit-breaker pole passes; the link 12 is coupled to a rod 13 having at its end a disk 24 again which bears a first spring 25 coaxial with the rod 13 and used in the maneuver to trip the circuit-breaker; for this reason, the spring 25 is called the tripping spring. The spring 25 is surrounded by a cylinder 26 coaxial with the rod 13 and the height of which is substantially equal to that of the spring 25 when the latter is charged. The purpose of this cylinder will be explained below. The spring is kept charged by at least one retractable abutment 27 that can be maneuvered by an opening coil 28 energized by devices for maneuvering and/or protecting the circuit-breaker, not shown. There can be a plurality of abutments maneuvered simultaneously, but for simplicity the remainder of the description refers to only one abutment.

The operating mechanism includes a mobile assembly including a cylinder 30 concentric with the axis xx attached to a disk 31 against which bears a first end of a second spring 32 used to set the circuit-breaker and for this reason called the setting spring. The second end of the spring 32 bears on a bottom 33 of the frame 20.

The spring 32 is kept charged by at least one retractable abutment 34 that can be maneuvered by a closing coil 35 energized by the devices for maneuvering and/or protecting the circuit-breaker, not shown.

The cylinder 30 is extended by a series of pivoting fingers 36 forming a corolla and adapted to open in the same manner. These fingers, which are used to recharge the tripping spring, are referred to as resetting fingers hereinafter.

Figure 3:
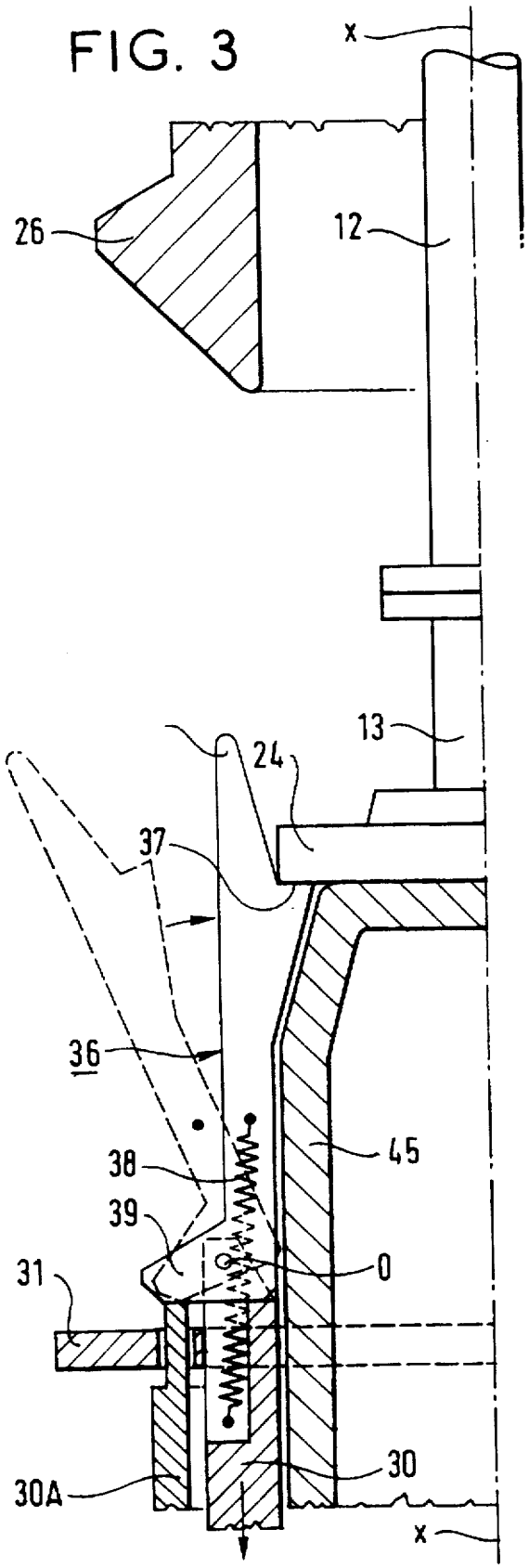
FIGS. 3 and 4 show a resetting finger in two positions of use.
Figure 4:
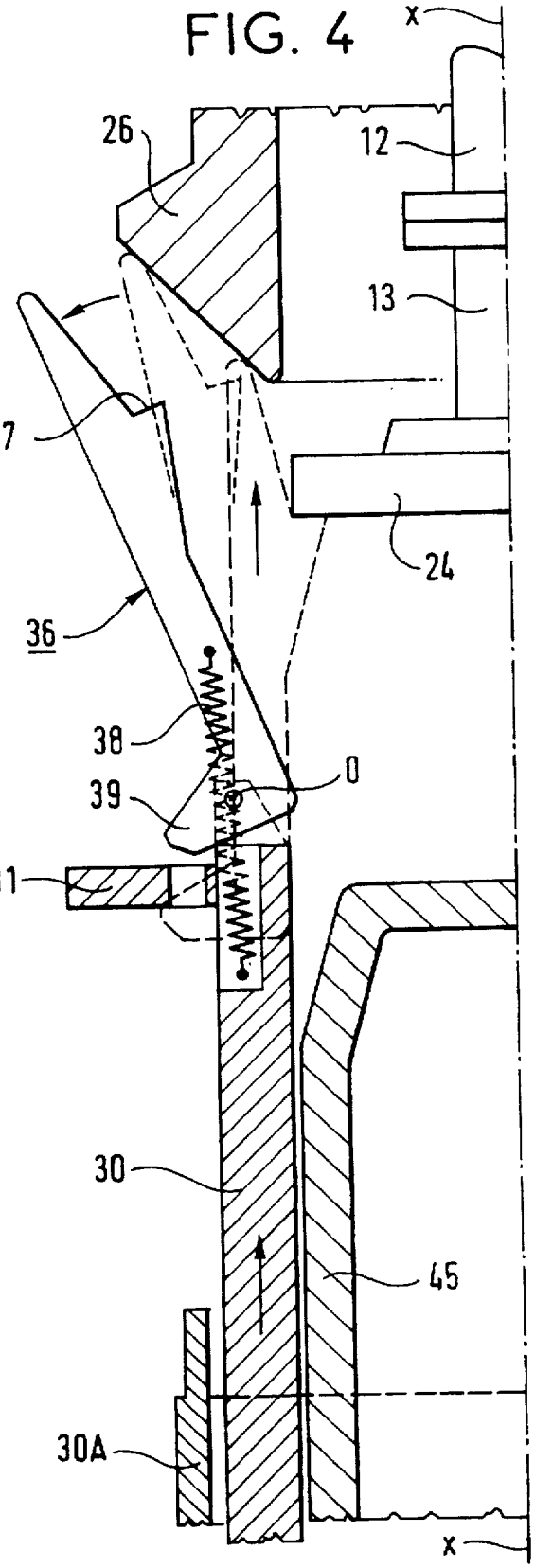

Turn to FIGS. 3 and 4.

Each finger 36 has, about one third along its length from the top end, an attachment shoulder 37 directed towards the axis xx. Each finger 36, pivoted at the point 0 at the end of the cylinder 30, is equipped with a spring 38 fixed at a first end to the finger itself and at its second end to the cylinder 30. This spring constitutes an overcenter toggle or "tumbler" device enabling the finger 36 to occupy two fixed positions on either side of the pivot axis O of the finger. Finally, the external part 39 of the foot of the finger cooperates with a fixed jacket 30A coaxial with the cylinder 30 to move the fingers from the spread apart position to the inverse position when the cylinder 30 reaches its bottom position.

Refer again to FIG. 2.

When the spring 32 is relaxed, it can be recharged by a device including arms 40 parallel to the axis xx equiangularly disposed around the axis, for example two or three such arms. The arms pass through appropriate openings in the bottom 33. At the top, the arms are linked by a horizontal ring 41. At their other end, the arms 40 are fixed to a plate 42 (or alternatively to two arms), to which is fixed the end of a screwthreaded rod 43, concentric with the axis xx and which can be moved in translation along the axis xx by a reversible electric motor 44.

The motor 44 and the rod 43 are accommodated in a cylindrical housing 45 attached to the bottom 33 and closed by a plate 46 with a hole 46 through which the rod 43 passes. The cylinder 45 also provides a guide for the cylinder 30.

The operating mechanism functions in the following manner.

In normal operation, when the circuit-breaker is in the set position, the springs 25 and 32 are charged, in which condition they are maintained by the abutments 27 and 34, respectively (FIG. 2).

Figure 5:
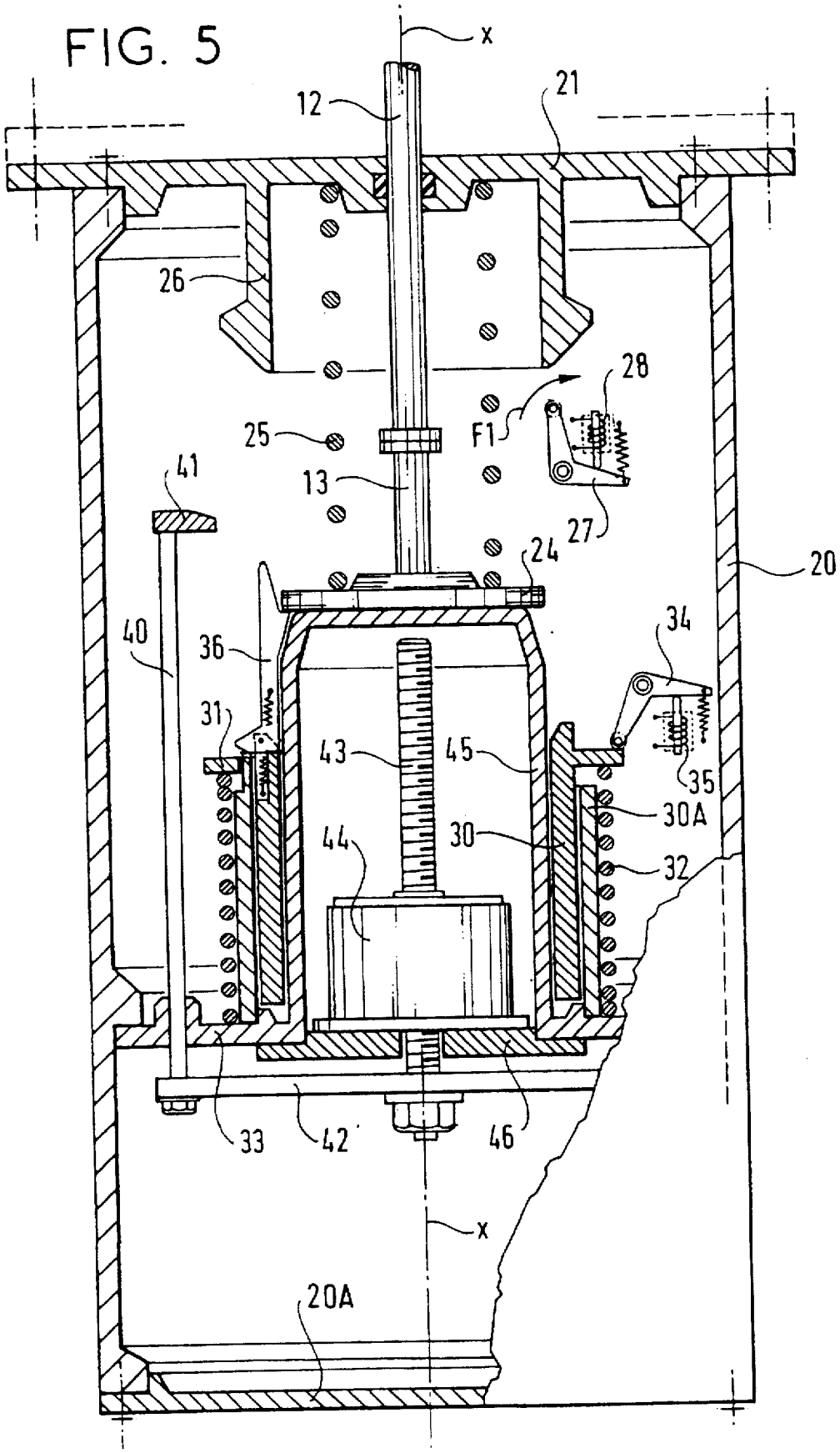
FIG. 5 is a view of the operating mechanism in axial section, in the configuration after opening.

When an open instruction is issued, the opening coil 28 is energized and retracts the abutment 27, which pivots in the direction of the arrow F1. The tripping spring 25 relaxes, entraining the circuit-breaker operating link (FIG. 5). At the end of this movement, the plate 24 rests on the shoulders of the fingers 36.

A close instruction given 0.3 s after the circuit-breaker opens energizes the closing coil 35 which retracts the abutment 34 which turns in the direction of the arrow F2.

Figure 6:
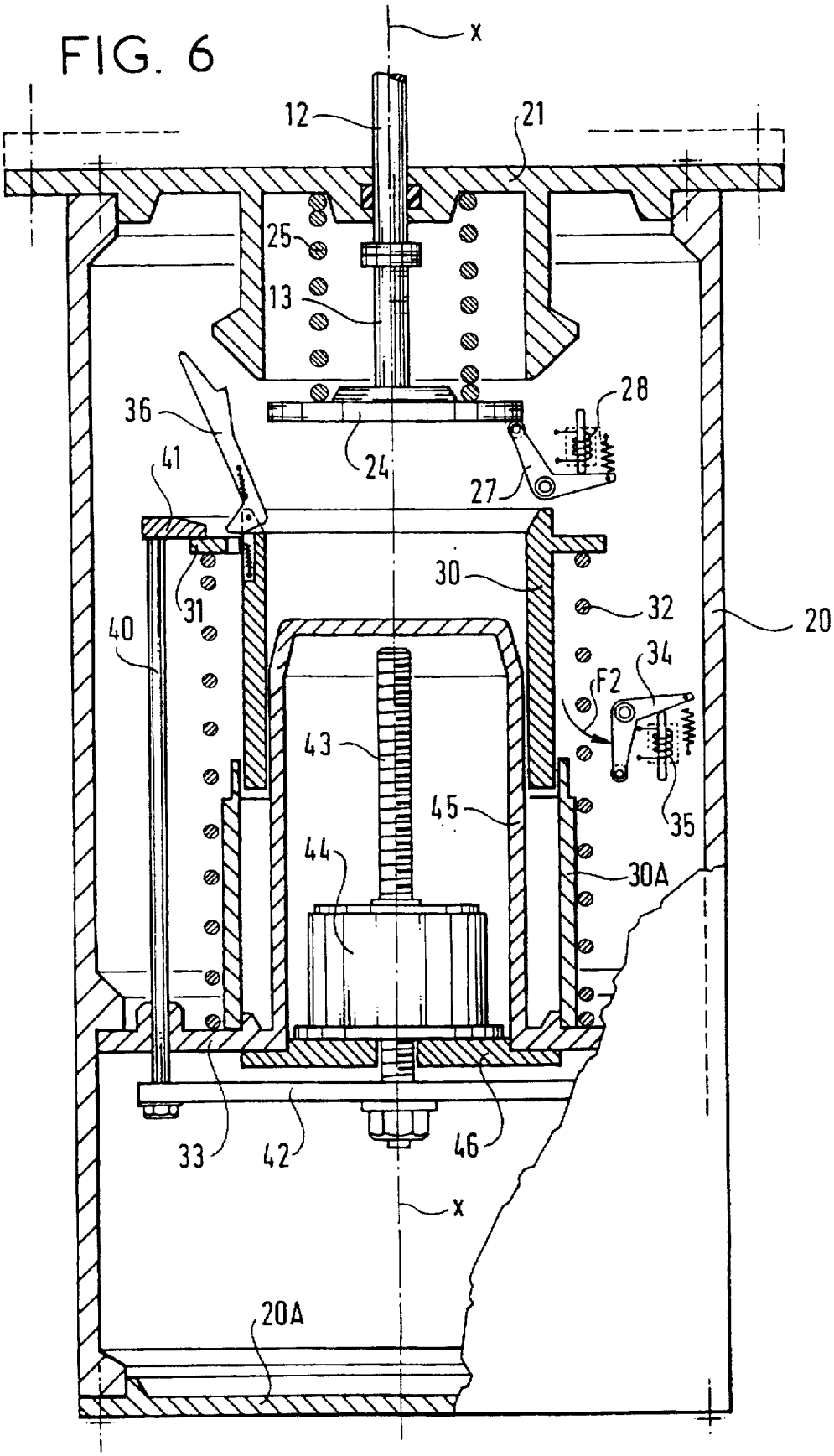
FIG. 6 is a view of the operating mechanism in axial section, in the configuration after reclosing.

The spring 32 relaxes, which displaces the cylinder 30. The fingers 36 entrain the disk 24, which sets the circuit-breaker and compresses the tripping spring 25. The normal position of the disk 24 is overshot by a few millimeters, enabling the abutment 27 to resume its place. When the ends of the fingers 36 contact the cylinder 26, the end of which is beveled, the fingers 36 spread apart (FIG. 4), releasing the disk 24 which drops onto its abutment 27. The spring 38 holds the fingers 36 in the spread apart position. Following this setting the operating mechanism has the configuration shown in FIG. 6. Note that at the end of the tripping maneuver the ring 31 is in contact with the ring 41.

The spring 32 is stronger than the spring 25 in order simultaneously to impart the setting movement to the mobile assembly and to compress the spring 25.

A second opening may be necessary if the fault persists. It will be obtained as previously by energizing the opening coil 28 to retract the abutment 27 and allow the spring 25 to relax.

Figure 7:
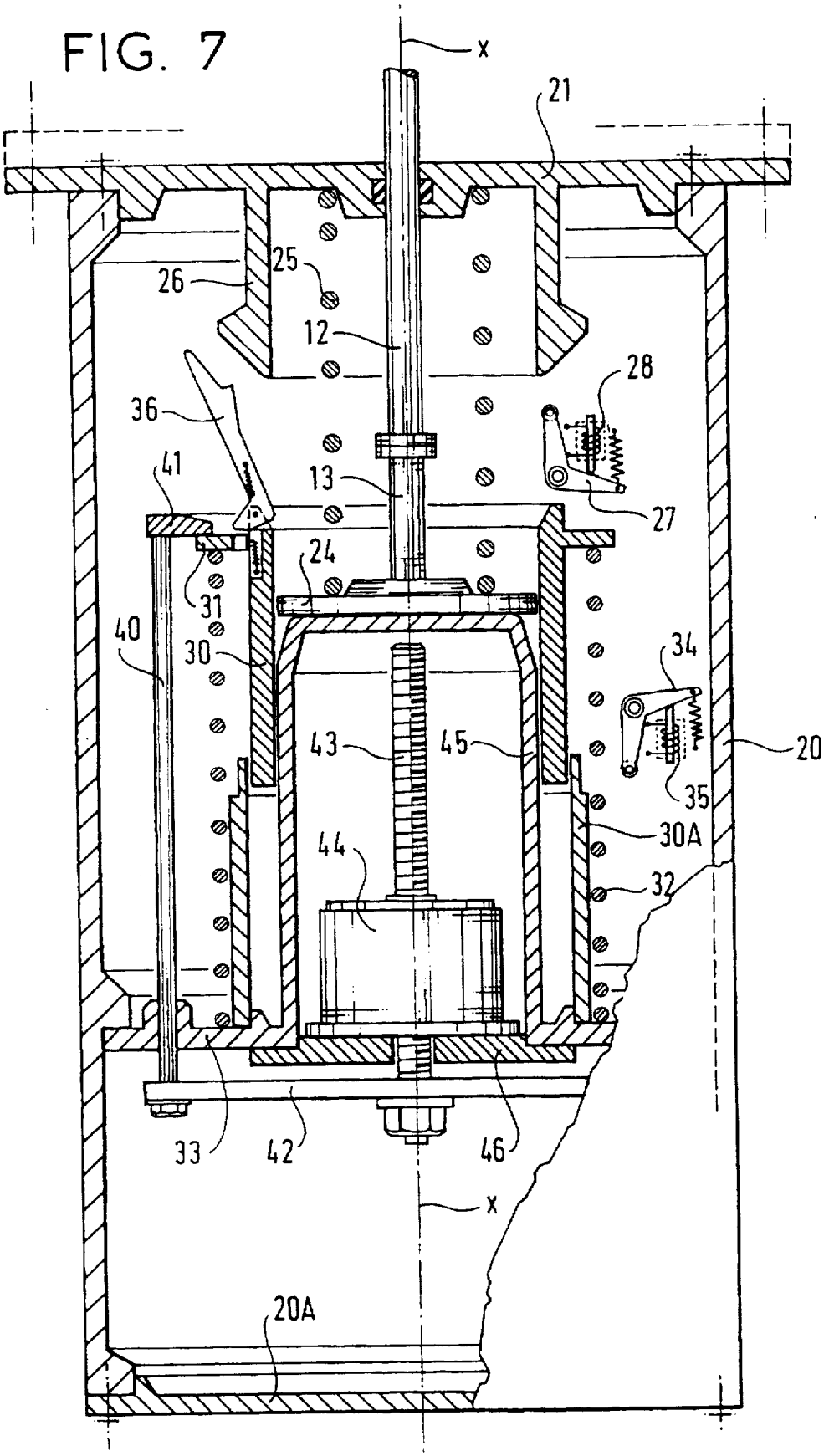
FIG. 7 is a view of the operating mechanism in axial section, in the configuration after the second opening of an OCO cycle.

At the end of this second opening, the configuration of the operating mechanism will be that shown in FIG. 7.

Figure 8:
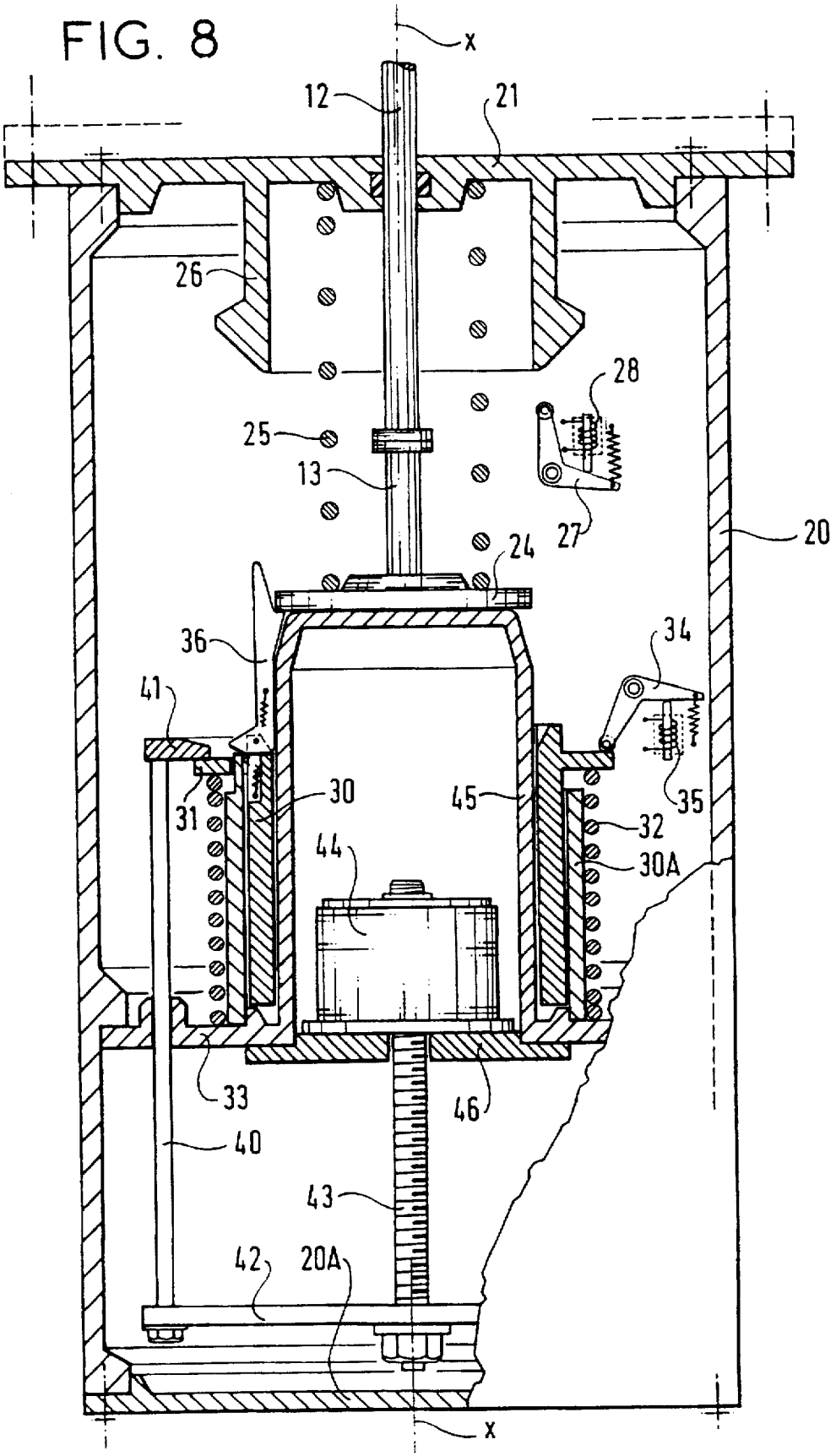
FIG. 8 is a view of the operating mechanism in axial section, in the configuration after reset, and before being returned to the configuration of FIG. 2.

According to the applicable standards, it must be possible for the circuit-breaker to be reset within a specified time-delay, for example 10 seconds. The operating mechanism of the invention allows this: immediately the second opening of the circuit-breaker is completed, the motor 44 is started; it pivots the screwthreaded rod 43 which entrains the disk 42 and the arms 40. The ring 41 entrains the ring 31 and the cylinder 30 to which it is attached. This maneuver compresses the spring 32. As previously, the rod 43 overshoots the mark slightly, which enables the abutment to resume its position on the ring 31. The motor 44 is stopped, at which point the configuration is that of FIG. 8. The motor is immediately started in the opposite direction to return the operating mechanism to the configuration of FIG. 2, i.e. with the ring 41 at the top.

The period of ten seconds for effecting this maneuver is sufficiently long to allow the use of a motor with a relatively low power rating, for example approximately 150 W.

The invention avoids the disadvantages mentioned in the preamble, in particular the problems caused by the ratchet wheels. The operating mechanism is compact and entirely in the form of a body of revolution, giving it a compact overall size.

There is claimed:

1. An operating mechanism for a circuit-breaker for effecting a rapid opening, closing and reopening cycle of the circuit-breaker (O-C-O cycle), said operating mechanism including a rod coupled to a circuit-breaker operating link, said rod being movable by a first or tripping spring, said operating mechanism further including a second or setting spring coaxial with an axis of the first spring and expansion of said setting-spring compresses said tripping spring, said operating mechanism also including means for compressing said tripping spring after a tripping operation, said compressing means including a motor coaxial with said springs and driving in translation along an axis of the motor a second rod disposed on the axis of said springs, said second rod being attached to arms cooperating with a ring on which said setting spring bears.

2. The operating mechanism claimed in claim 1 wherein said bearing ring on which said setting spring bears is attached to a mobile cylinder one end of which cooperates with a disk on which said tripping spring bears during compression of said tripping spring.

3. The operating mechanism claimed in claim 2 wherein said end of said mobile cylinder includes a ring of pivoting fingers provided with shoulders on which said bearing disk of said tripping spring bears during the compression of the tripping spring, said fingers coming into contact at the end of the travel of said cylinder with a fixed cylinder and spreading apart, releasing said disk.

4. The operating mechanism claimed in claim 3 wherein the travel of said mobile cylinder overshoots a normal abutment position of said bearing disk of said tripping spring in order to enable repositioning of abutments of said disk.

5. The operating mechanism claimed in claim 3 wherein said pivoting fingers include an overcenter toggle device to enable said ring of fingers to assume two fixed positions.

6. The operating mechanism claimed in claim 5 wherein the foot of each finger has an external portion cooperating with a fixed cylinder to enable pivoting of pivoting fingers to move from a first of the two fixed positions to the second of the two fixed positions at the end of the tripping operation to recompress said setting spring.

7. The operating mechanism claimed in claim 1 wherein an end of said arms is fixed to a common ring which bears on said bearing ring of said setting spring during recompression of said setting spring.

8. The operating mechanism claimed in claim 7 wherein the travel of said arms overshoots a normal abutment position of said bearing ring of said setting spring to enable repositioning of abutments of said ring.

9. The operating mechanism claimed in claim 7 wherein compression of said setting spring is immediately followed by operation of said motor in a reverse direction to reposition said ring common to said arms at a position not bearing on the bearing ring.

* * * * *